US005661494A

United States Patent [19]

Bondyopadhyay

[11] Patent Number: 5,661,494

[45] Date of Patent: Aug. 26, 1997

[54] HIGH PERFORMANCE CIRCULARLY POLARIZED MICROSTRIP ANTENNA

[75] Inventor: Probir K. Bondyopadhyay, Houston, Tex.

[73] Assignee: The United States of America as represented by the Administrator of the National Aeronautics and Space Administration, Washington, D.C.

[21] Appl. No.: 410,625

[22] Filed: Mar. 24, 1995

[51] Int. Cl.[6] ..... H01Q 1/38

[52] U.S. Cl. ..... 343/700 MS; 343/829

[58] Field of Search ..... 343/700 MS, 829, 343/846; H01Q 1/38

[56] References Cited

U.S. PATENT DOCUMENTS

| | | | |
|---|---|---|---|
| 381,968 | 5/1888 | Tesla . | |
| 3,921,177 | 11/1975 | Munson | 343/846 |
| 4,125,837 | 11/1978 | Kaloi | 343/700 MS |
| 4,125,838 | 11/1978 | Kaloi | 343/700 MS |
| 4,125,839 | 11/1978 | Kaloi | 343/700 MS |
| 4,191,959 | 3/1980 | Kerr | 343/700 MS |
| 4,464,663 | 8/1984 | Lalezari et al. | 343/700 MS |
| 4,543,579 | 9/1985 | Teshirogi | 343/365 |
| 4,713,670 | 12/1987 | Makimoto et al. | 343/700 MS |
| 4,755,821 | 7/1988 | Itoh et al. | 343/700 MS |
| 4,761,654 | 8/1988 | Zaghloul | 343/700 MS |
| 4,833,482 | 5/1989 | Trinh et al. | 343/700 MS |
| 4,843,400 | 6/1989 | Tsao et al. | 343/700 MS |
| 4,866,451 | 9/1989 | Chen | 343/700 MS |
| 4,903,033 | 2/1990 | Tsao et al. | 343/700 MS |
| 4,914,445 | 4/1990 | Shoemaker | 343/700 MS |
| 4,929,959 | 5/1990 | Sorbello et al. | 343/700 MS |
| 4,943,809 | 7/1990 | Zaghloul | 343/700 MS |
| 4,973,972 | 11/1990 | Huang | 343/700 MS |
| 5,231,406 | 7/1993 | Sreenivas | 343/700 MS |
| 5,233,361 | 8/1993 | Boguais | 343/700 MS |
| 5,278,569 | 1/1994 | Ohta et al. | 343/700 MS |
| 5,376,942 | 12/1994 | Shiga | 343/700 MS |
| 5,382,959 | 1/1995 | Pett et al. | 343/700 MS |

FOREIGN PATENT DOCUMENTS

| | | | |
|---|---|---|---|
| 0134804 | 10/1981 | Japan | 343/700 MS |

OTHER PUBLICATIONS

"Circular polarisation and bandwidth," M. Haneishi & Y. Suzuki, Handbook of Microstrip Antenna, vol., Chapter 4, J. R. James & P. S. Hall Editors, Peter Peregrinus Ltd. (IEEE), London, pp. 221, 270–272, 1989.

"Circularly Polarised Antenna Arrays", K. Ito, T. Teshirogi & S. Nishimura, Chapter 13, James & Hall Editors, p. 804, 1989.

*Primary Examiner*—Donald T. Hajec
*Assistant Examiner*—Tho Phan
*Attorney, Agent, or Firm*—Hardie R. Barr

[57] ABSTRACT

A microstrip antenna for radiating circularly polarized electromagnetic waves comprising a cluster array (20) of at least four microstrip radiator elements (22*a*–22*d*), each of which is provided with dual orthogonal coplanar feeds in phase quadrature relation achieved by connection to an asymmetric T-junction power divider (30) impedance notched at resonance. The dual fed circularly polarized reference element is positioned with its axis at a 45° angle with respect to the unit cell axis. The other three dual fed elements in the unit cell are positioned and fed with a coplanar feed structure with sequential rotation and phasing to enhance the axial ratio and impedance matching performance over a wide bandwidth. The centers of the radiator elements are disposed at the corners of a square with each side of a length d in the range of 0.7 to 0.9 times the free space wavelength of the antenna radiation and the radiator elements reside in a square unit cell area of sides equal to 2d and thereby permit the array to be used as a phased array antenna for electronic scanning and is realizable in a high temperature superconducting thin film material for high efficiency.

3 Claims, 11 Drawing Sheets

HIGH PERFORMANCE CIRCULARLY POLARIZED MICROSTRIP ANTENNA

FIELD OF THE INVENTION

This invention relates generally to microstrip antennas for circularly polarized radiation and more particularly to a unique optimally configured four element wideband array cluster arrangement of planar microstrip radiator elements, each of which is provided with coplanar dual orthogonal microstrip feeds with T-junction type power dividers in phase quadrature relation for circularly polarized radiation, and wherein the array is excited in sequential rotation and phasing to enhance the axial ratio of circular polarization over a wide bandwidth and is optimally figured within an optimum compact unit cell to be suitable for use in a phased array antenna for electronic scanning and for realization in high temperature superconducting thin films for higher efficiency.

BACKGROUND OF THE INVENTION

Microstrip array antennas transmitting or receiving circularly polarized electromagnetic waves in the microwave and millimeter wave range are extensively used in communications systems such as mobile-satellite communications, direct-broadcasting-satellite systems, navigation and radar systems. They are particularly useful where the antenna resides on a moving platform, e.g. an automobile, truck or a spacecraft, which must be in constant communication with its counterpart on another platform which may be either stationary or moving.

Circular polarization is usually achieved by combining two orthogonal linearly polarized waves which are equal in amplitude and are radiating in phase quadrature relation. The tip of the radiated electric field vector rotates in a circle in the plane transverse to the direction of propagation and is right circular polarized when rotating clockwise and left circular polarized when rotating counterclockwise looking in the direction of propagation. Performance requirements of the communication system dictate the design for the particular microstrip antenna characteristics and often the conventional circularly polarized microstrip antenna is comprised of an array of microstrip radiating elements when the required gain is higher than that of a single radiating element.

The conventional method of obtaining a circularly polarized array is to arrange circularly polarized microstrip patches with appropriate feeding. Various types of circularly polarized patches are used as array elements and include those which can support two orthogonal (in space) modes of excitation, more common ones being circular or square in shape. These two orthogonal resonant modes are excited with equal amplitude and in phase quadrature (differential phase shift of 90°) with dual feed to produce the appropriate sense of circularly polarized radiation. However, by means of an appropriate structural perturbation to the circular polarizable radiating patches, it is possible to excite circular polarization of the appropriate sense by means of a single feed point excitation. While the required length of feed lines is reduced, the single feed excitation is fundamentally inferior to dual feed excitation in terms of antenna performance such as measured by axial ratio bandwidth. This is so because at a frequency slightly off resonance, the amplitude and phase differential between the two orthogonal linearly polarized fields will always be much larger than when using dual feed excitation because of the steep slope of the impedance resonance curve at frequencies off-resonance.

Microstrip radiators may be excited by direct feeding or indirect feeding. There are essentially two ways of direct feeding. One is to use coplanar microstrip line feed and the other is to use perpendicular coaxial feed with a pin exciting the microstrip from the bottom. There are also two ways of indirect feeding the microstrip radiators. One is by means of electromagnetic or capacitive coupling through one or more dielectric layers and the other through an aperture in a conducting surface below the microstrip and separated by one or more layers of dielectrics from the feed. The aperture, in turn, could be fed by a microstrip feed line one or more dielectric layers below the aperture.

The working of a practical circularly polarized microstrip array antenna is characterized by several important performance parameters which include the radiation gain pattern, impedance bandwidth, axial ratio bandwidth, antenna efficiency and side lobe level. When electronic scanning by a full phased array or subarray is involved, maximum available scan angle and the variations of gain, beamwidth, axial ratio, side lobe level and antenna input impedance with scanning are also important. Antenna efficiency that tells how much of the antenna input power is converted into useful output power for communication is a very important performance measure. Signal power losses in the feed structure decreases the antenna efficiency. Lower efficiency for a transmitting array antenna means lesser signal power is radiated whereas lower efficiency for a receiving array antenna means more noise is introduced in the captured signal adversely affecting the signal detection capability of the communication system. Axial ratio bandwidth is a measure of the operational frequency range over which the desired sense of circular polarization remains useful. Impedance bandwidth of the antenna array is the operational frequency range over which the antenna radiates the input power effectively. These two bandwidths, as is known to those skilled in the art, most substantially be the same for a well designed circularly polarized array. Larger axial ratio bandwidth is achieved at the expense of implementing dual feed to the elements resulting in more feed line loss of signal and consequent reduction in efficiency. To provide adequate scanning capability and higher gain for a given array, the radiating elements in an array must be arranged with smaller spacing but sufficient to incorporate the feed structure with tolerable minimum feed structure coupling. A good array antenna design must take into account the actual communication system requirement and provide an optimum balance between conflicting design requirements.

The fundamental concept of generating circularly polarized electromagnetic fields by means of simultaneous sequential rotation and phasing (SSRP) of N independent linearly polarized fields is the revolutionary invention of Nikola Tesla (U.S. Pat. No. 381,968, May 1, 1888) that placed him in the U.S. National Inventor's Hall of Fame. This technique, for N=2 applied to a single square or circular microstrip element capable of supporting two orthogonal degenerate (same resonant frequency) linearly polarized modes, has been used as described before, to produce circularly polarized microstrip antennas as shown in U.S. Pat. No. 3,921,179.

In U.S. Pat. No. 4,866,451 (Chen) there is disclosed a circular polarization technique for a microstrip array antenna which utilizes dual feed to the radiator elements. This description is solely concerned with the improvement of axial ratio bandwidth and does not at all address the important practical issue of antenna efficiency. The four element subarray in the design disclosed therein requires seven hybrid power dividers, each requiring a lumped resistance termination. The fact is that if quadrature hybrid power dividers are to be used for exciting each individual element in the subarray, the axial ratio bandwidth will be very good enough that further improvement by sequential rotation and phasing of the 2×2 array may not be necessary. A further drawback is that each element requires two orthogonal feed with vertical coaxial feed pins from the bottom which is inconvenient to fabricate and is often electrically unreliable for pure circular polarizations at frequencies above 15 GHz. A more serious drawback is that accommodation of these seven hybrids within the array unit cell requires larger area and space, thus severely limiting the electronic scanning capability of the array.

While arrays of individual microstrip radiators are primarily used to increase the antenna gain, if-electronic scanning is an additional requirement for the array then there is necessity of placing restrictions on the element spacings to prevent the appearance of grating lobes during scanning. The four element cluster, acting as a building block for a larger array, then, is provided with phase shifters to provide electronic scanning. The entire coplanar feed structure must be accommodated within the confines of the four element cluster in such a fashion that detrimental inter-feed line coupling is minimized.

In order to improve upon the axial ratio bandwidth of a circularly polarized array of single feed structurally perturbed elements, Teshirogi in U.S. Pat. No. 4,543,579 has applied this well known SSRP technique of Tesla to a subarray of such elements implemented by a coplanar microstripline feed structure. There is an appreciable improvement on the available axial ratio bandwidth but that may not be sufficient for many wideband communication applications. Further, since sequential rotation and phasing is applied in two stages to the multi-element array, such antenna was not designed and is ill-suited for electronic scanning capability.

Applying the SSRP technique of generating a circular polarization signal, a two element subarray building block has been constructed and described by Haneishi and Suzuki (J. R. James and P. S. Hall Editors, Handbook of Microstrip Antennas Handbook, 1989, Peter Peregrinus Ltd. (IEE), London, Chapter 4, pp. 270–272) and Ito, Teshirogi and Nishimura (Chapter 13, pp. 804 of ref. as above). This two element unit employs structurally perturbed circular polarizable elements with single coplanar microstrip line feed provided by T-junction power dividers and extra 90° phase delays provided by additional path lengths. Circular polarized microstrip elements with dual feed provided by coplanar microstripline T-junction power dividers are well known in the literature (J. R. James and P. S. Hall Editors, Handbook of Microstrip Antennas, 1989, Peter Peregrinus Ltd. (IEE), London, Chapter 4, pp. 221). Using such elements, Sreenivas in U.S. Pat. No. 5,231,406 has constructed a modified two element building block with a staggered arrangement that leads to a triangular grid array. Axial ratio bandwidth improvement has been considered, in isolation, as the design goal without concurrent attention to the antenna gain, antenna size and efficiency. The axial ratio bandwidth improvement has been proposed at the expense of undesirable loss of antenna gain. This is evidenced by the fact that there are only eight elements in the array area of $16d^2$ where d is the distance between two consecutive rows or columns in the array and the feed structure layout does not uniformly utilize the available space. This results in a nearly 50% loss in array antenna gain for a given array area caused by the loss in the antenna effective area.

For communications at higher microwave frequencies there is a present need for an optimally configured denser packed circularly polarized microstrip array that will eliminate the necessity of using quadrature hybrids without sacrificing the axial ratio performance obtainable from dual feed elements. It should be of simple construction and permit electronic scanning. It should also be realizable in a single conducting thin film so that very high antenna efficiency could be obtained by drastic reduction of feed line losses with realization of the array antenna in high temperature superconducting thin films.

It is therefore an object of the present invention to provide an optimum circularly polarized microstrip array antenna design wherein the axial ratio bandwidth is equal to or better than the impedance bandwidth and also wherein the variation of axial ratio over the entire beamwidth and bandwidth of interest is minimized without undue sacrifice of antenna gain and efficiency. It is also an object to provide a robust microstrip array antenna with dual feed elements that will radiate highly pure circular polarization over the frequency band of interest, is realizable in a single conducting layer thin film, employs an efficient and compact topology, makes optimum use of the unit array area and space without sacrificing performance, and maintains an excellent capability of electronic scanning.

SUMMARY OF THE INVENTION

The invention is a high performance microstrip antenna for radiating circularly polarized electromagnetic waves. The antenna is comprised of a of an optimally configured cluster array of microstrip radiator elements, each of which is provided with dual orthogonal coplanar feeds in phase quadrature relation to produce circularly polarized radiation and wherein the array is excited in sequential rotation and phasing to enhance the axial ratio of circular polarization over a wide bandwidth. The relative phase shift in the dual feeds to each radiator element is achieved by an asymmetric T-junction power divider which is impedance matched at the resonant center frequency and thereby eliminates the need for a hybrid power divider. All other power dividers in the feed structure are realized by the coplanar T-junction power dividers and necessary phase shifters realized by coplanar feed line lengths permitting the realization of the entire cluster in one plane. The critical part of the invention is the realization of the optimally configured dual fed four element cluster which results from the reference element together with its microstrip line T-junction power divider being placed with its reference axis at a 45° angle with the unit cell reference axis. The dual fed power elements of the cluster are placed in a square grid with a spacing d equal to 0.7 to 0.9 times the free space wavelength at the operating frequency and within a square unit cell area of sides equal to 2 d thereby permitting this array to be used in a phased array antenna for electronic scanning purposes. A mirror image of the structure produces the opposite sense of circular polarization.

DETAILED DESCRIPTION OF THE INVENTION

Figure 1:
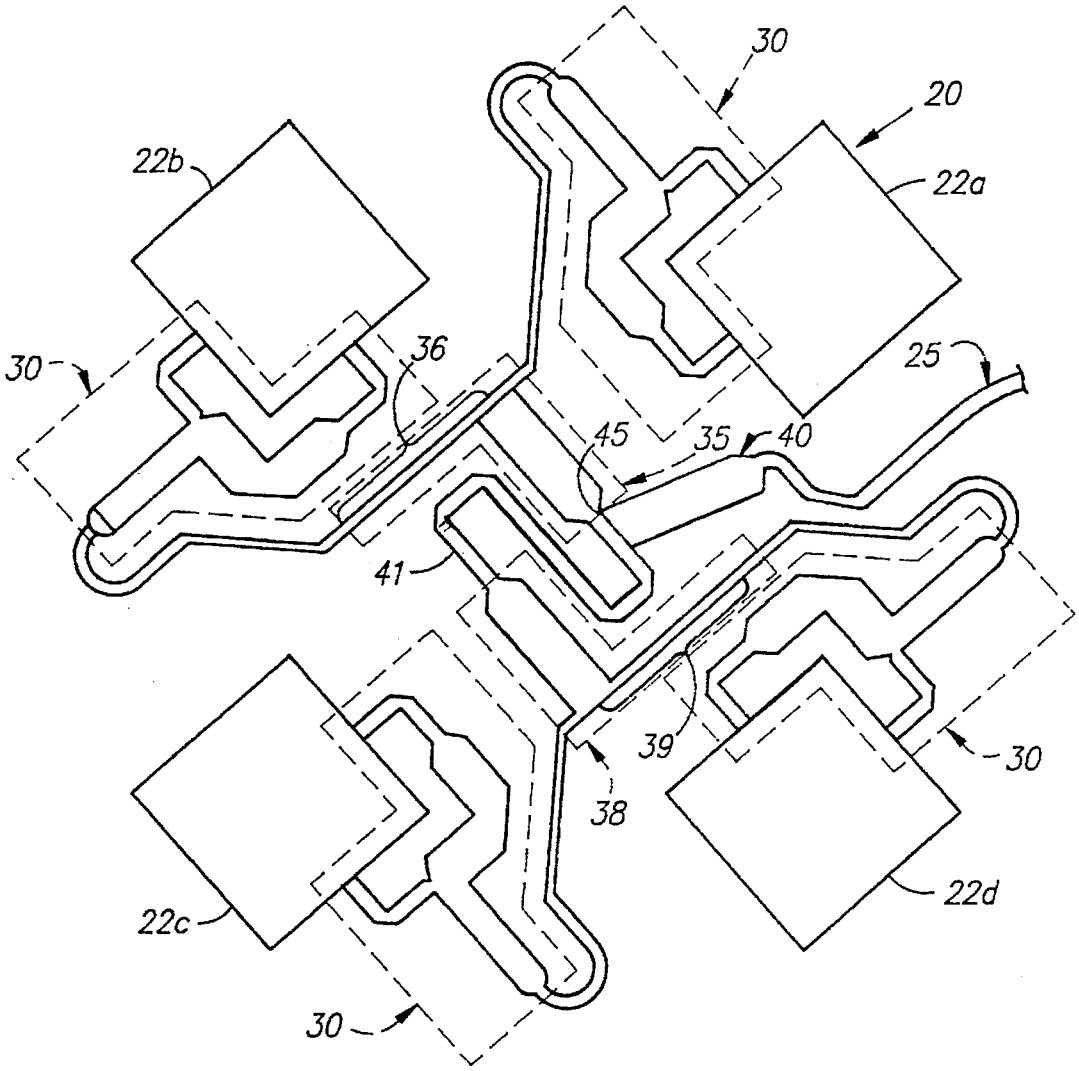
FIG. 1 is a schematic diagram of a four element microstrip antenna array with microstrip feed lines in accordance with the invention for producing right circularly polarized radiation.
Figure 3:
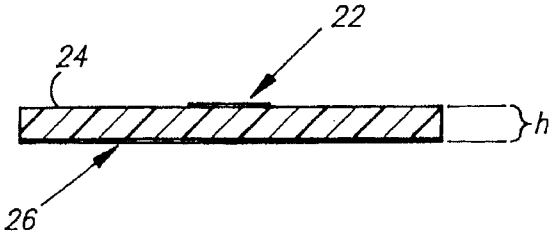
FIG. 3 is a fragmentary cross sectional view of a typical microstrip antenna for illustrating the relationship of the radiator element, the conducting ground plane element, and the dielectric substrate of the antenna.

Referring more particularly to the drawings, there is shown in FIG. 1, an optimally configured four element microstrip antenna array cluster 20 which represents a preferred embodiment of the invention. The antenna array is specifically designed for transmitting or receiving right circular polarization. Each radiating element 22*a*–22*d* in the array 20 is a square shaped electrically conducting metal sheet 22, such as copper, on a thin dielectric plate 24 of thickness h equal to approximately 0.015 to 0.1 times or approximately 1% to 10% of the operating wavelength, and the backside of which is fully metallized, as shown in FIG. 3. The backside metal cladding 26, such as copper cladding, serves as the ground plane of the antenna.

Figure 2:
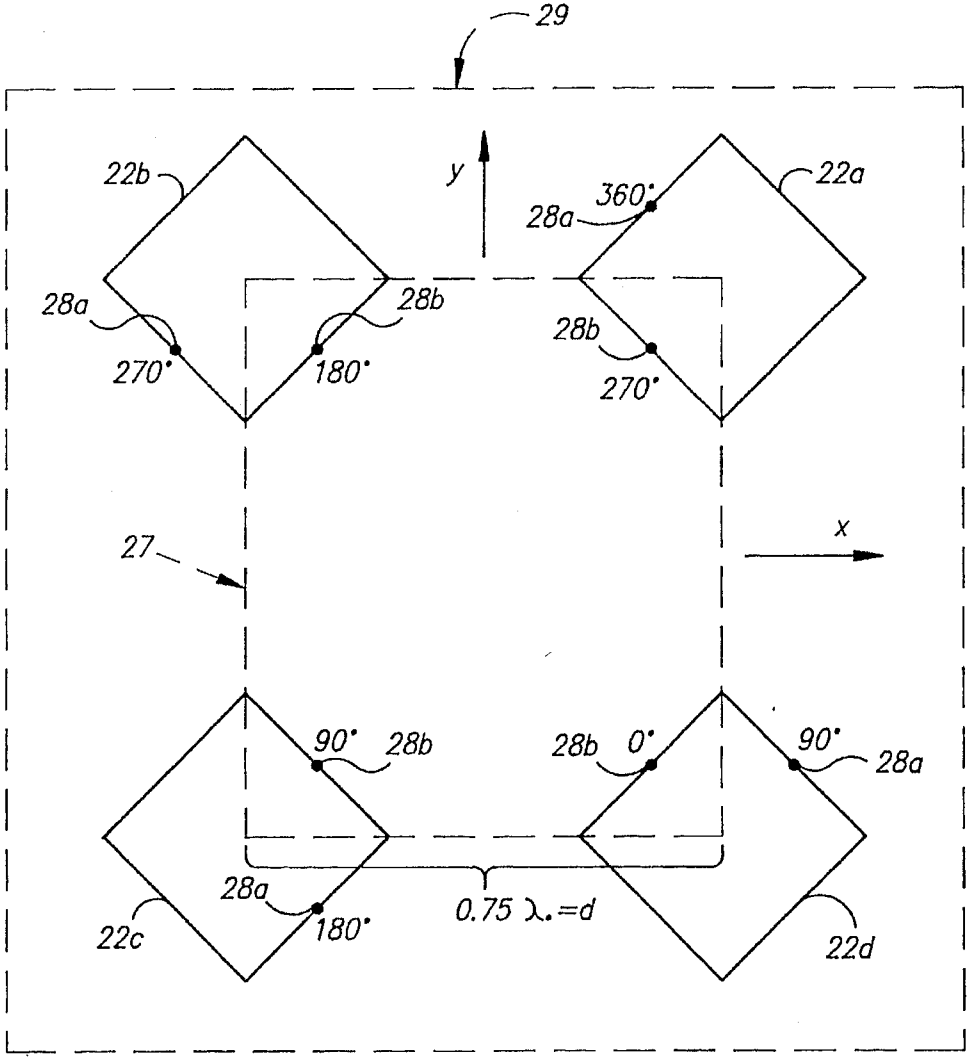
FIG. 2 is a schematic plane view of the four radiator elements of the cluster array of FIG. 1 and showing the relative positioning of the radiator elements and the excitation phase distributions of the dual feeds to these elements.

In FIG. 2, there is shown a schematic illustration of the relative orientations of the microstrip radiator elements (22*a*–22*d*) of FIG. 1 along with the two feed points 28*a*, 28*b* for each radiator and the relative phases of their feed line excitations so that the radiator elements (22*a*–22*d*) individually and as a cluster array generate right circularly polarized radiation. Referring to FIG. 2, one of the radiator elements, such as element 22*a*, is a reference radiator element with two feed points phased at 360° and 270°. The reference axis of this reference element is then defined as the line joining the 270° phase feed point and the center in the direction of the center.

In this preferred embodiment of the invention, the radiator elements are arranged in a square area 27 wherein the geometric center of each radiator element is at a different corner of the square and the spacing d between each pair of the square radiator elements corresponding to a side of the square is 0.75 times the free space wavelength $\lambda_0$ of the radiated wave, although a value of d in the range of d=0.7 $\lambda_0$ to d=0.9 $\lambda_0$ is acceptable. The radiator elements 22*a*–22*d* are also symmetrically located within a square unit cell area 29 of sides equal to 2d, and the reference element of the array is related with its reference axis at a 45° angle with respect to the unit cell x-axis as shown in FIG. 2. In other embodiments (not shown), the radiating elements could be circular in shape or in the form of an annular ring which is resonant at the radiation frequency.

In the four element cluster array 20, a microstrip feeder structure is provided whereby the radiator elements (22*a*–22*d*) are excited in sequential rotation in the positions (0°, 90°, 180°, 270°) and are simultaneously sequentially phased so as to strongly enhance the right circularly polarized radiation.

Figure 4:
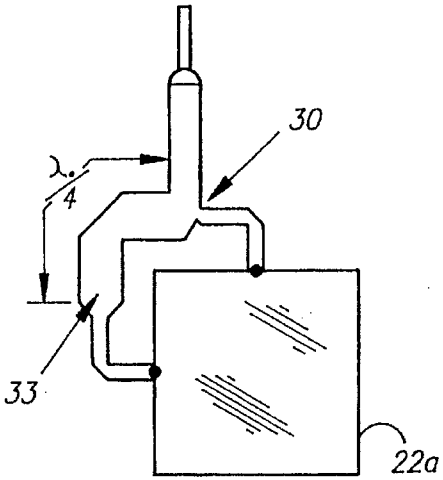
FIG. 4 is a schematic plan view of a single microstrip radiator element of the array of FIG. 1 and showing the asymmetric T-junction power divider used for dual feed.

It is shown in FIG. 4 that the feeding of each radiator element (22*a*–22*d*) is accomplished by means of a microstrip line T-junction power divider 30. The correct design of this T-junction is crucial to the successful operation of the antenna.

First of all, it is to be noted that the 90° phase shift to the orthogonal feed point of the antenna element is provided by means of extra line length (quarter wave length) of the microstrip line feed. This quarter wave length extra line 33 is also simultaneously used to provide equal amplitude for the excitation signal at the two feed ends at the center frequency of resonance and thus serves the dual role of an impedance transformer as well as a phase shifter.

Again referring to FIG. 4, assume $Z_r$ be the impedance presented by each linear polarization port of the microstrip radiating element to the feed line and $l_1$ and $l_2$ be the electrical lengths of the nominal and 90° phase delayed branches of the feed line. Then $$l_2 = l_1 + \frac{\lambda_g}{4},$$

where $\lambda_g$ is the microstrip feed line wave length. If $Z_1$ and $Z_2$ be the transformed impedances of the respective branches seen at the electrical reference plane of the T-junction bifurcation, simultaneous satisfaction of the phase and amplitude conditions for the right circular polarization excitation and the quarter wavelength matching transformation requires that the following condition be satisfied:

$$\text{Real part of } Z_1 = -\text{Imaginary part of } Z_1$$

For a microstrip feed line with chosen characteristic impedance, $R_f$, the above condition imposed on the transmission line impedance relations gives the unique value of the length $l_1$ by solution of the following equation:

$$R_r R_f \tan^2(\beta l_1) + (R_f^2 - R_r^2)\tan(\beta l_1) + R_r R_f = 0$$

where $$\beta = \frac{2\pi}{\lambda_g},$$

$R_r$=real part of $Z_r$, and $\lambda_g$ is the microstrip feed line wave length. The characteristic impedance of the matching $$\frac{\lambda_g}{4}$$

line can then be calculated to be √2 times the Real part of $Z_1$ for this unique value of $l_1$.

It will be appreciated by those skilled in the art, that the radiation resistance presented to the microstrip feed line by the perfect square or circular patch radiator element is large enough such that the feed line with characteristic impedance equal to this radiation resistance will have such a small width that it can not be reliably fabricated for all practical purposes. It is this situation that determines the necessity of using the matched T-junction. The feeding microstrip line needs to be matched at the junction using a quarter wavelength transformer as is shown in FIG. 4.

The feed structure of the element contains perpendicular bends of the feed line for conserving space in the array and in calculating the electrical lengths of the line the effects of the bends must be taken into account and are known to those skilled in the art. From the analyses available in the literature for microstrip line asymmetric T-junctions, accurate positions of the electrical reference planes at the junction, as good as possible, should be utilized in the design.

As shown in FIG. 1, the elements 22*a*–22*d*, each resonant at the center frequency of radiation, are each rotated in their respective positions, as shown by locations of their feed points, in a counter-clockwise sequence of 0°, 90°, 180°, 270°. Each radiating element has dual feeding (equal amplitude, phase quadrature) by an impedance-matched T-junction microstrip line power divider 30 to excite the desired sense of right circular polarized radiation or left circular polarized radiation, if so desired. The phase quadrature (90° phase shift) provided by this feed structure for each radiator element is realized by the extra quarter wavelength long $$\left(\frac{\lambda_g}{4}\right)$$

feed line 33 in one of the branches of the divider 30 which is connected directly thereto. The present invention of the optimally configured four element cluster results from the discovery that the reference dual feed element along with its microstrip line T-junction lower divider feed structure must be positioned with its reference axis at a 45° angle with the unit cell axis for optimal use of the entire available unit cell area for the coplanar dual feed structure layout.

As shown in FIG. 1, such matched-fed radiator elements 22*a* and 22*b* are also fed by a microstrip matched T-junction type, power divider 35, fifth power divider, the two branches of which connect to the two power dividers 30 associated with the elements 22*b* and 22*a* and provides additional 90° phase shift to the element 22*b* by means of an extra quarter wavelength $$\left(\frac{\lambda_g}{4}\right)$$

long feed line 36 in a branch thereof which is coupled to the input end of the power divider 30 which feeds the radiator element 22*b*. A similar feeding arrangement including a T-junction power divider 38, the sixth power divider, is provided for the pair of radiator elements 22*c* and 22*d* with the extra 90° phase shift provided to the radiator element 22*d* by the branch 39 with a length $$\left(\frac{\lambda_g}{4}\right).$$

The two pairs of fed elements so created are additionally fed by a matched microstrip line, T-junction type, power divider 40 so as to provide an extra 180° phase shift to the pair of elements 22*c* and 22*d*. This additional phase shift is realized by an extra half wavelength $$\left(\frac{\lambda_g}{2}\right)$$

long feed line 41 which constitutes one output branch of the seventh power divider 40. The other output branch of the-divider 40 is also the input branch of the divider 35. Thus, the four fed radiator elements (22*a*–22*d*), sequentially rotated in their respective positions in the counterclockwise direction, will receive sequential phase shifts of 0°, 90°, 180° and 270° in the counterclockwise direction. The cluster 20 thus described, will accordingly provide and very strongly favor right circular polarized radiation. It is to be noted, however, that a mirror image of the array structure shown in FIG. 1, will provide left circular polarized radiation.

Figure 5:
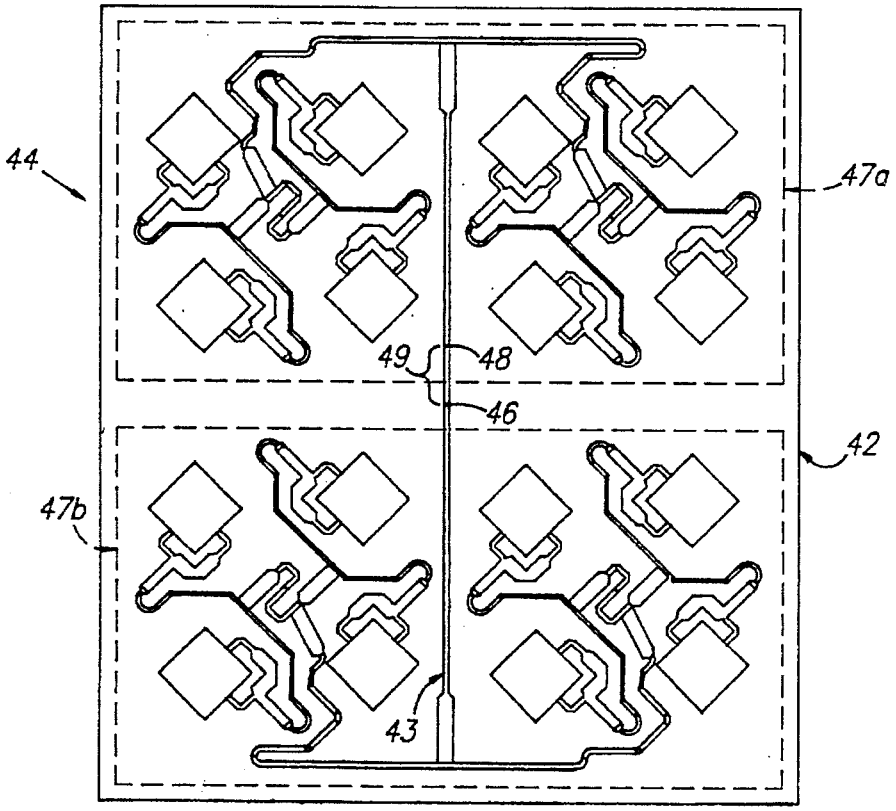
FIG. 5 is a schematic plan view of a 16 element microstrip antenna array which is comprised of a plurality of microstrip antenna arrays shown in FIG. 1.

The four element array cluster so invented is fed either by a vertical probe from the bottom at the feed point 45 as is feasible in FIG. 1 and illustrated in the embodiment of the invention shown in FIG. 13 to be hereinafter described or by microstrip line 43 as shown in the sixteen element array 44 of FIG. 5, which array is comprised of four cluster arrays, each similar to the array 20 of FIG. 1.

In such a sixteen element array 44, each four element cluster array may be considered as a subarray wherein the subarrays are symmetrically disposed about a geometric center point 46. The array 44, which is superposed above a parallel metal ground plane 42 and separated therefrom by air or a dielectric material, may also be considered to be comprised of two sub-array unit pairs 47*a* and 47*b* of four element arrays, both of which are coupled by microstrip feed line to a feed point 48, which, in turn, may be coupled through a coaxial connector or additional microstrip feed line to an appropriate signal transmission source (not shown). The array 44 is adapted to generate or receive circularly polarized radiation and accordingly, the path length of microstrip line 49 between the feed point 48 and the geometric center point 46 is such as to provide a signal delay which produces a 180° phase shift in the signal to the sub-array unit 47*b* relative to the signal to the unit pair 47*a*.

In addition, the unit pair 47b is physically rotated by 180° relative to the unit pair 47a such that the unit pairs 47a, 47b are in actual in-phase relationship when generating or receiving circularly polarized radiation. In the cluster array 20, there is a sequence of incremental rotational shifts of 90° between the number N of radiator elements where N=4. The sixteen element array 44 in FIG. 5 may be considered to be comprised of N subarrays of four element clusters incrementally shifted by 360° with respect to one another, where N=2.

It is therefore to be appreciated that prominent achievements of this invention are that the entire dual feed line structure required in this invention has been optimally and uniformly accommodated within the array unit cell area minimizing the size of the square grids and with all of the radiator elements and the dual-feed structure being in the same plane.

Figure 6:
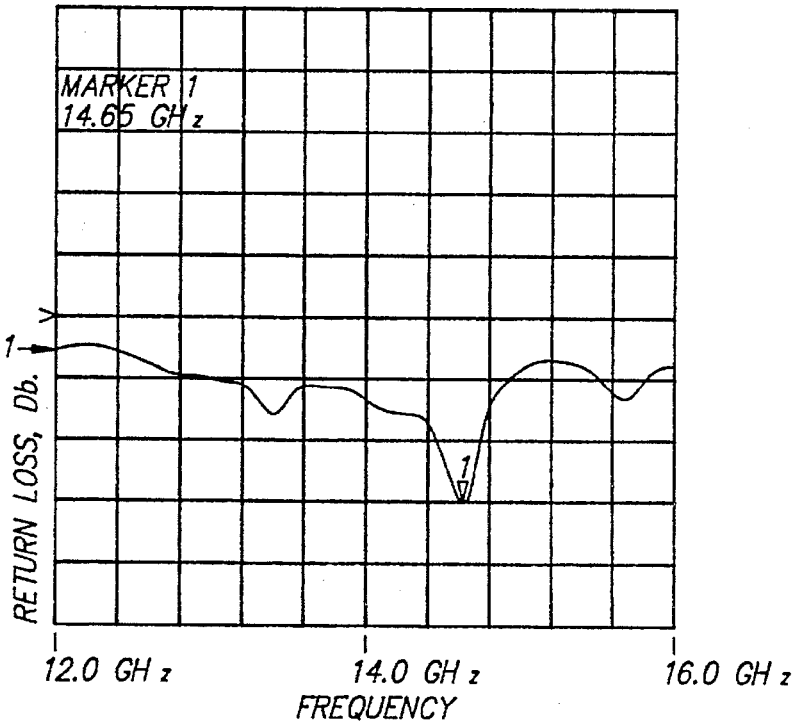
FIG. 6 is a graph of measured return loss of a four element array of the invention as shown in FIG. 1.
Figure 7:
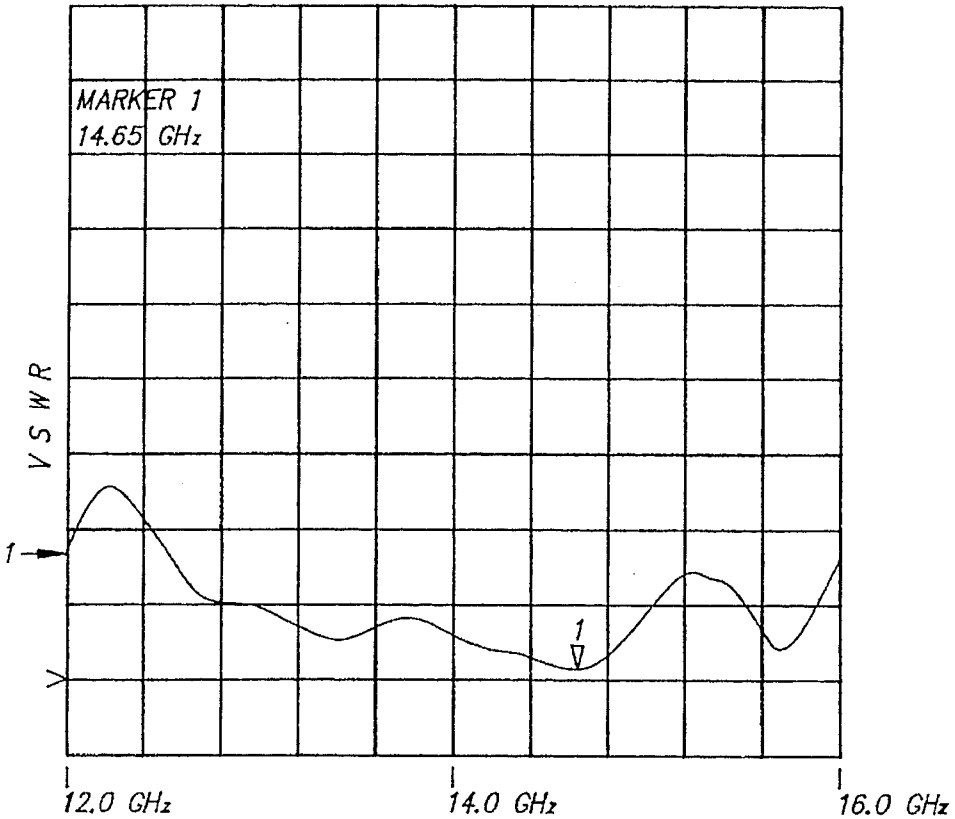
FIG. 7 is a graph showing the standing wave ratio measurement versus frequency for the four element array shown in FIG. 1.

For the four element array of FIG. 1, the measured return loss versus frequency is shown in FIG. 6. The voltage standing wave ratio measurement versus frequency is shown in FIG. 7.

Figure 8:
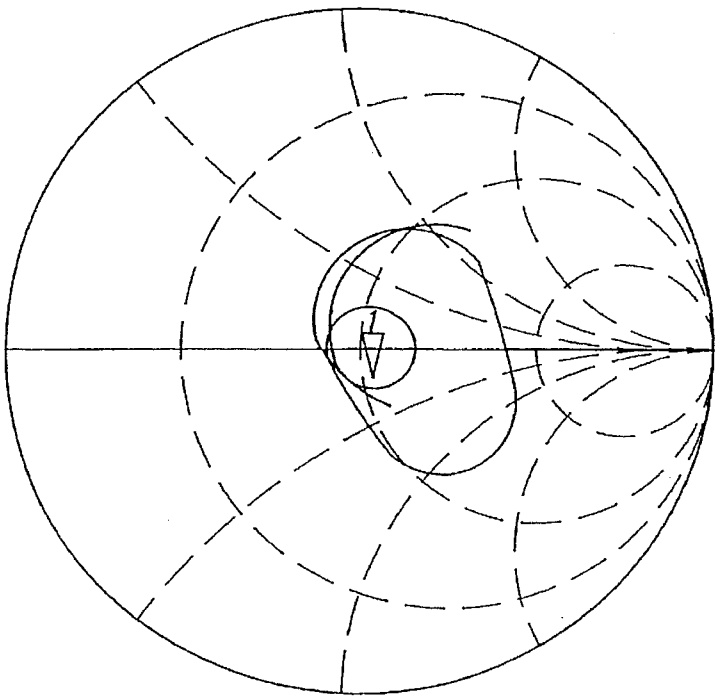
FIG. 8 is a Smith Chart measurement of the relation of impedance and frequency for a four element microstrip array as shown in FIG. 1.

The Smith chart for the four element microstrip array cluster of FIG. 1 is shown in FIG. 8. As in well known, the Smith chart displays the performance of a microwave circuit in terms of input impedance versus frequency and also the reflection coefficient versus frequency. For a given value of the measured reflection coefficient, the corresponding input impedance can be read directly from the plot. Since a movement by a distance d along the transmission line corresponds to a change in the reflection coefficient, as represented by a rotation through an angle 2 βd, the corresponding impedance point moves as a constant radius circle through this new angle to its new value. The contours of $\overline{R}$ and constant $\overline{X}$ for the normalized input impedance are represented by circles on the plot as shown. The angular rotation 2 βl in terms of wavelength λ is scaled along the circumference of the chart and the origin for the angular scale is chosen at the left side of the circle. In the circuit design, the goal is to match the transmission line impedance to the input impedance in order to obtain maximum power transfer. This occurs if the impedance plot is at the exact center of the large circle of FIG. 8 and as shown in the graph, the impedance is only slightly off center at frequency equal to 14.645 GHz.

Figure 9:
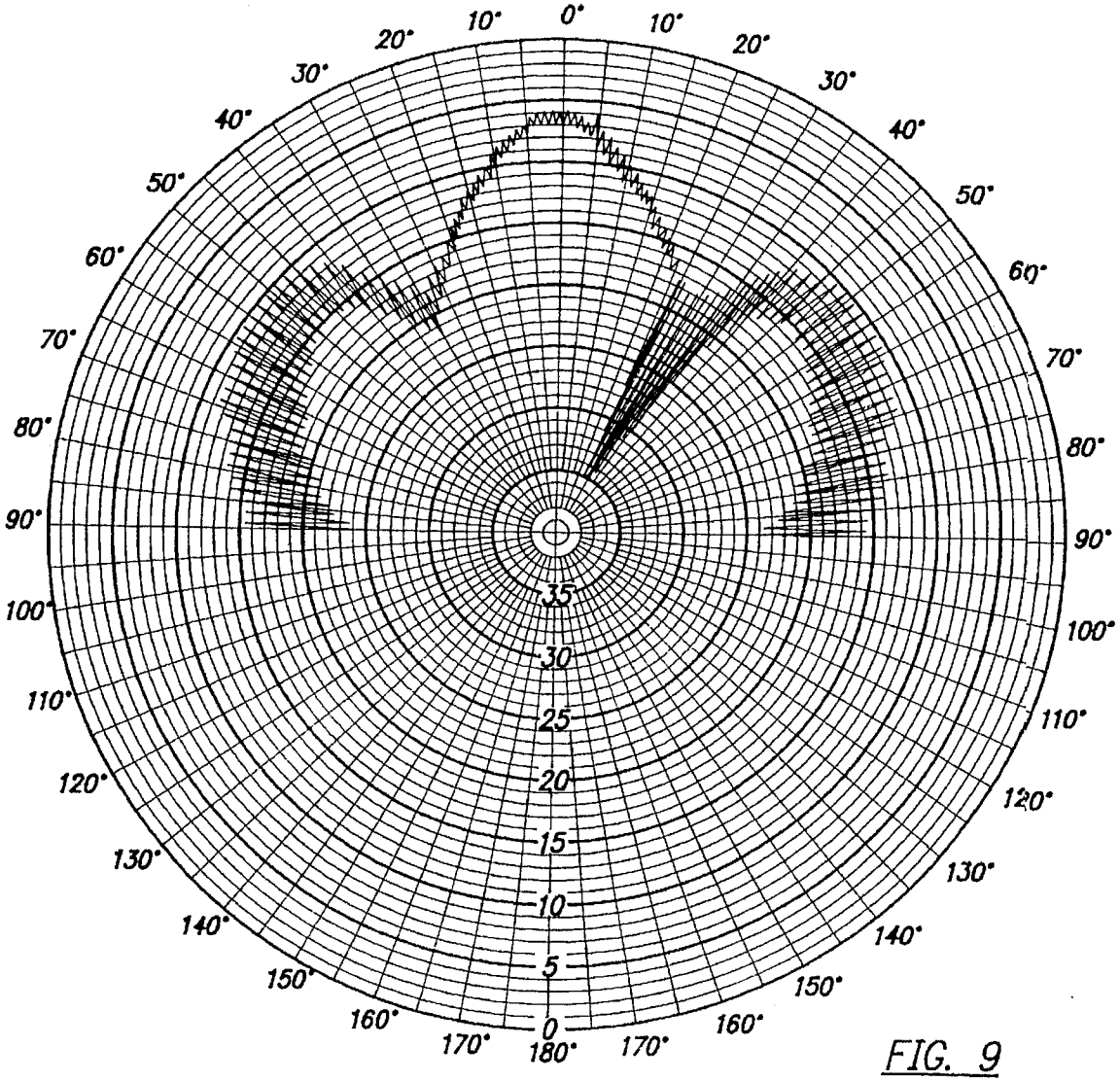
FIG. 9 is a graph of a radiation gain pattern of the four element microstrip array cluster of FIG. 1 as measured at the center frequency of 14.645 GHz.
Figure 10:
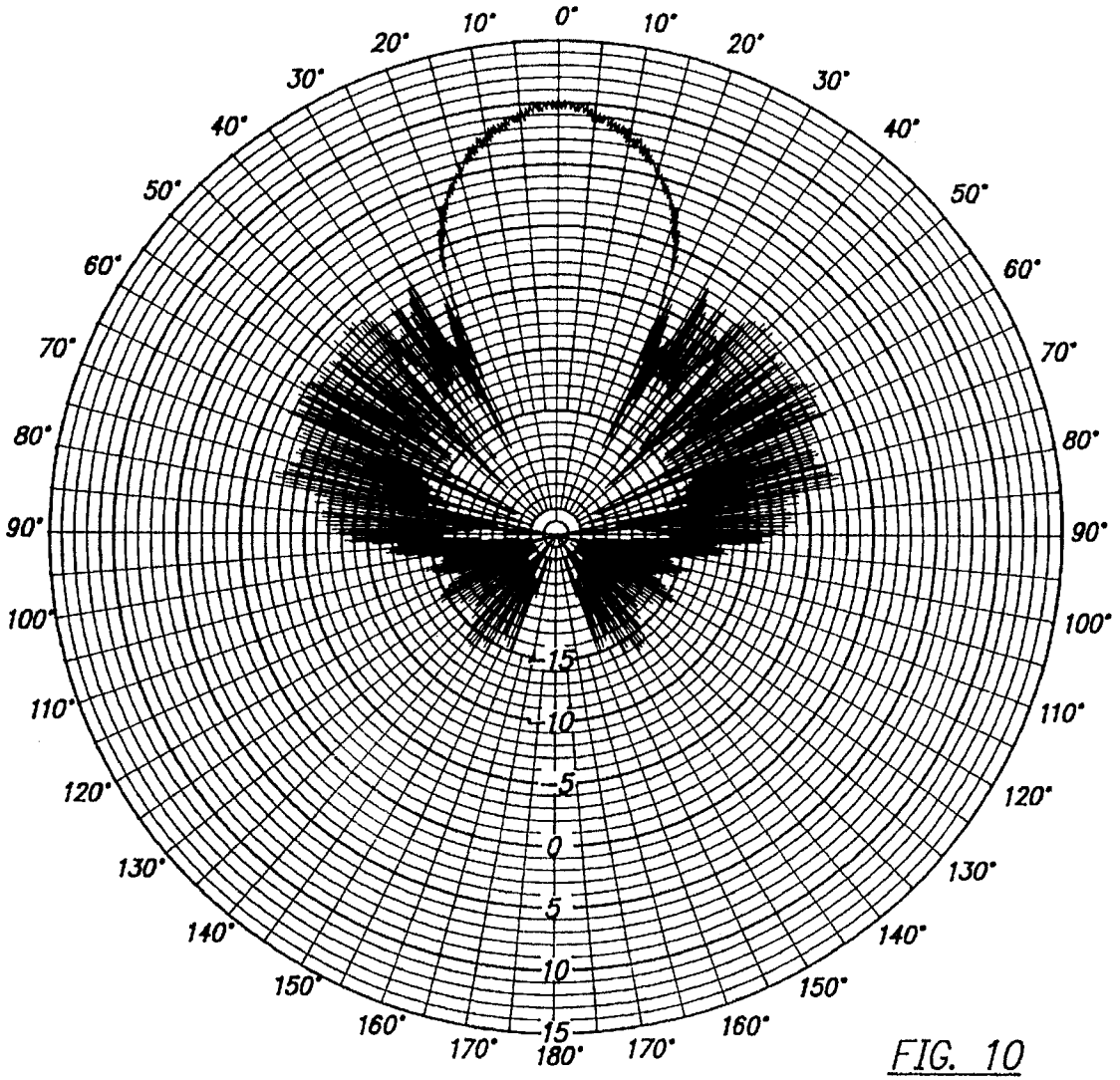
FIG. 10 is the graph of an antenna radiation gain pattern of a microstrip antenna array as shown in FIG. 5 and as measured at the center resonant frequency of 29.5 GHz in a principal plane when using rotating linear feed in accordance with the invention.
Figure 11:
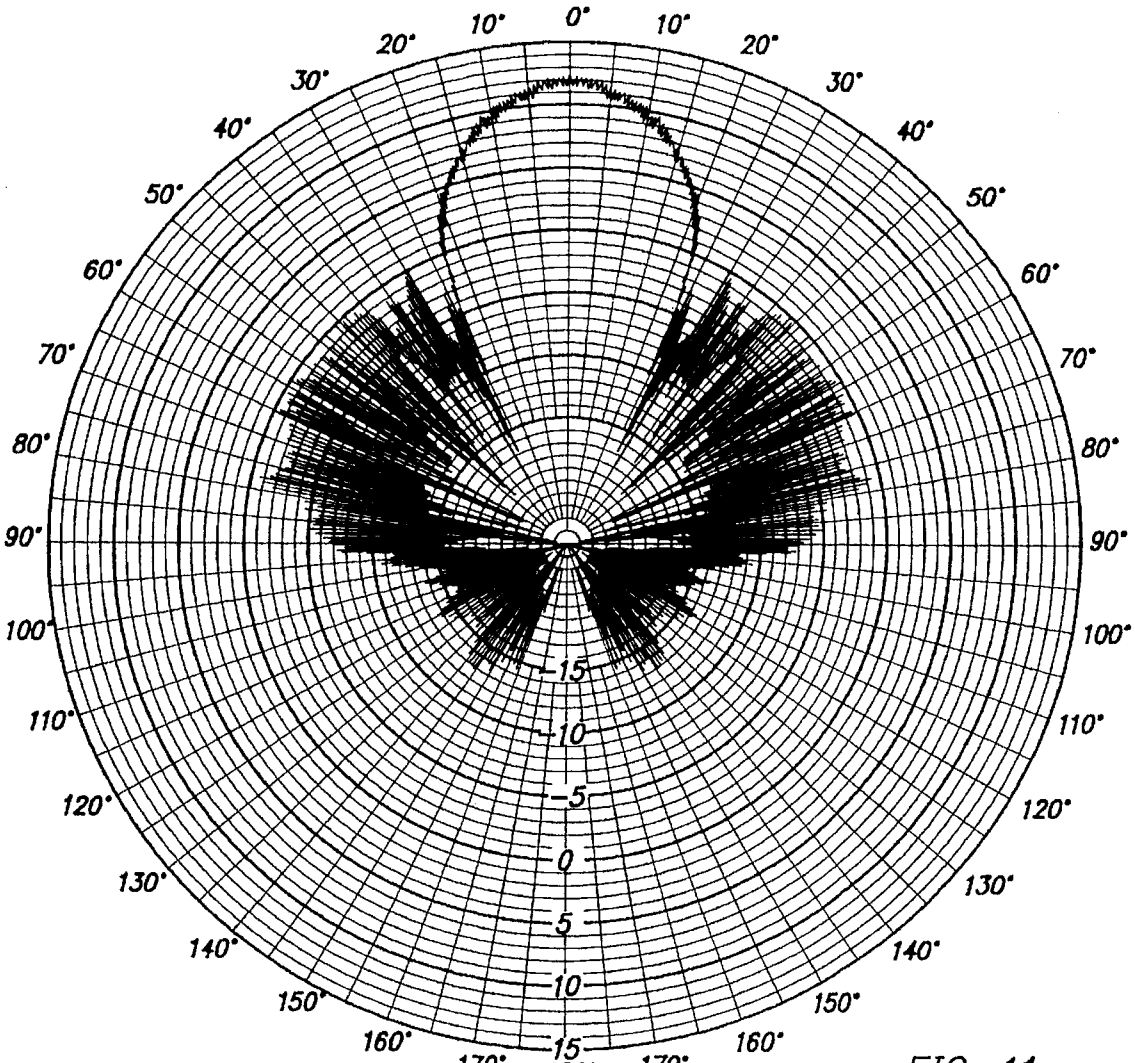
FIG. 11 is a graph of a radiation gain pattern in the principal plane at the frequency of 30.5 GHz as measured for the antenna array of FIG. 5.
Figure 12:
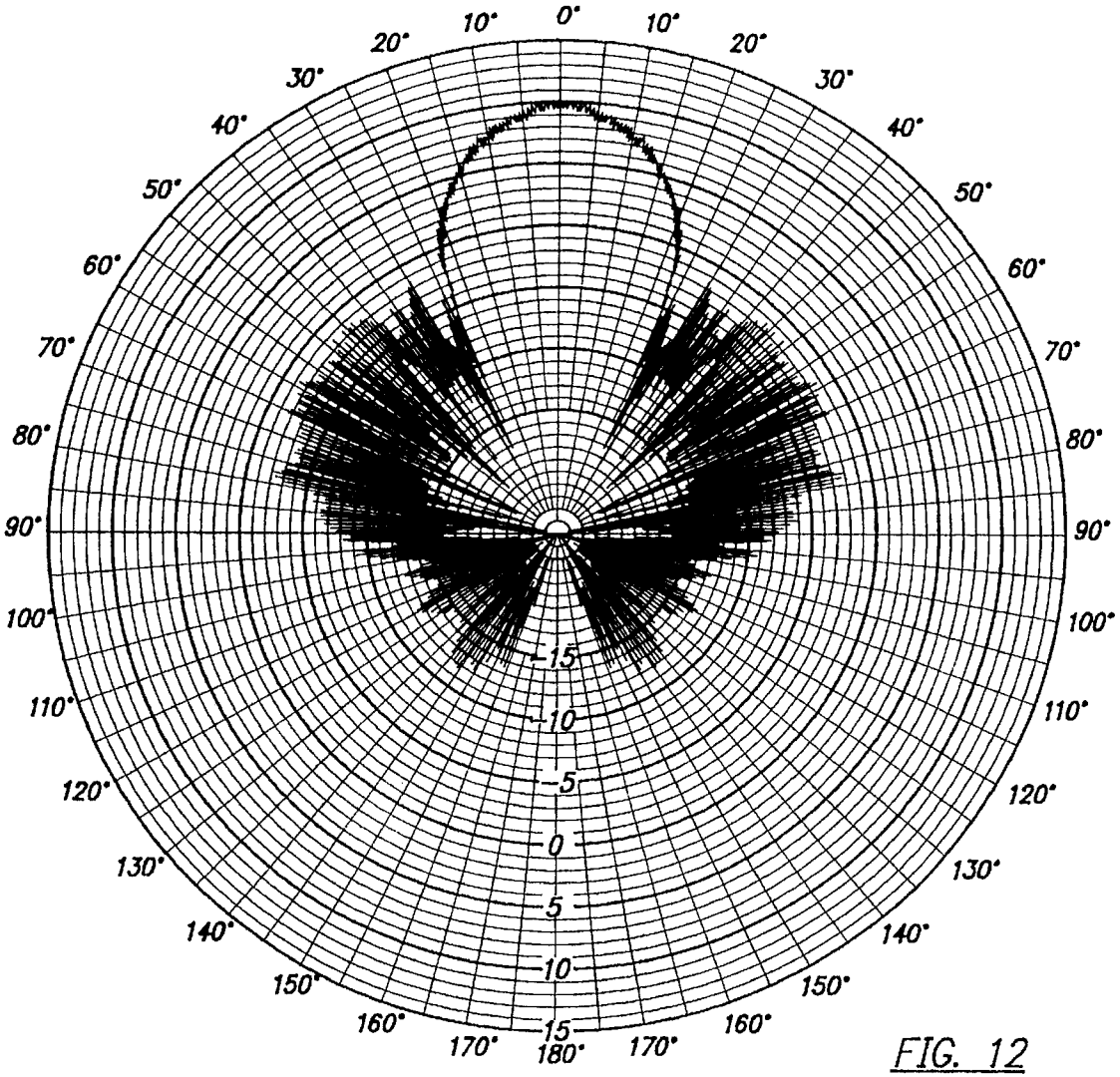
FIG. 12 is a graph of the radiation pattern of the antenna of FIG. 5 in the principal plane as measured at the frequency of 28.5 GHz.

The radiation gain pattern in the perpendicular principal plane for the microstrip array antenna of FIG. 1 is shown in FIG. 9 at the center resonant frequency of 14.645 GHz. For the 16 element microstrip antenna array of FIG. 5, there is shown in FIG. 10 an antenna radiation gain pattern as measured at 29.5 GHz in a principal plane when using a rotating linear feed in accordance with the invention. Similar radiation gain patterns for the antenna at a center resonant frequency of 30.5 GHz and at 28.5 GHz are shown in FIGS. 11 and 12, respectively.

It will therefore be seen that the provision of asymmetric T-junction type power dividers to provide dual orthogonal feed to each of the four optimally positioned radiator elements in the array of FIG. 1, together with the sequential rotation and feeding technique as described herein, produces a unique and compact high performance circularly polarized antenna array that uniformly utilizes the unit cell for layout of the feed structure and minimizing the square grid size. This four element array antenna and its feed structure are all disposed co-planar and reside within a square unit cell area 29 defined by sides of a dimension 2d where d is the distance between the geometric centers of the radiator elements, each located at the corners of a square with sides d of a dimension in the range of about 0.7 to 0.9 times the operating wavelength. This physical feature allows the realization of this high performance array antenna on the higher temperature superconducting thin films, such as for example, 140° Kelvin. It also permits the cluster array to be used as a phased array antenna element of a planar scanning array for electronic scanning when such use is desired.

It is also to be appreciated that heretofore designers of wideband circularly polarized microstrip array elements have implemented the T-junction power divider in the coplanar feed structure with dual fed elements at the cost of additional unit cell space and without being able to optimize the utilization of the unit cell space resulting in larger spacing between the elements. This reduces the array area efficiency and diminishes the array scanning capability. The array antenna of the present invention, provides superior performance without the forgoing disadvantages.

Figure 13:
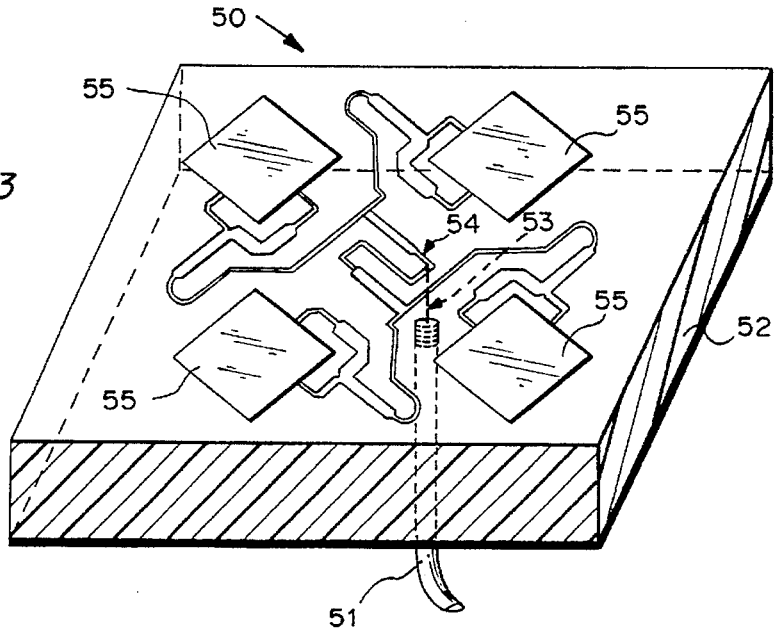
FIG. 13 is a perspective view of a modification of the invention in which the exciting signal for the antenna array is provided through a coaxial connector mounted on the back side of a conductor backed sheet of dielectric and extending through the dielectric to directly contact the microstrip feed structure at a feed point which is co-planar with the antenna array of radiator elements.

In FIG. 13 there is disclosed a modification 50 of the invention which is substantially identical to the array antenna 20 of FIG. 1 except that the feed network receives the exciting signal through a coaxial connector in lieu of microstrip. As will be seen in FIG. 13, the coaxial connector 51 is fixed to the backside of the conductor ground plane clad dielectric sheet 52 and extends through the dielectric substrate such that the inner conductor 53 of the connector makes electrical contact with and is secured to the metallized microstrip 54 on the front side of the dielectric in coplanar relation with the radiator elements 55. A coaxial feed may be preferred for applications where spare constraints are less limiting.

Figure 14:
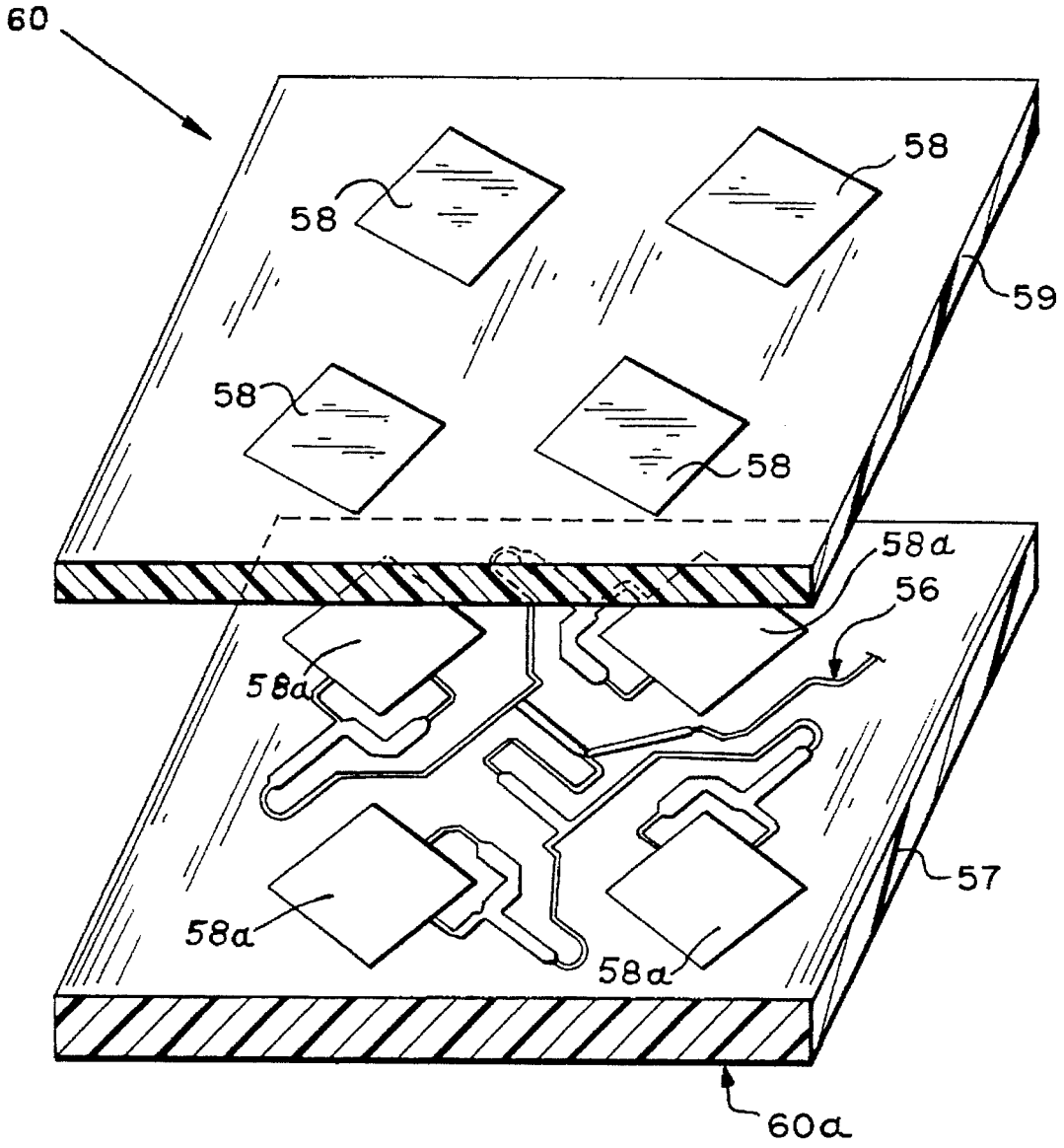
FIG. 14 is a perspective view of another modification of the invention in which the exciting signal for a planar array of antenna radiator elements is electromagnetically coupled thereto from a network feed structure mounted in parallel spaced relation to the antenna elements and including a second planar array of radiator elements.

In FIG. 14, there is shown another modified form 60 of the invention wherein a microstrip feed structure 56 which includes a cluster array of microstrip radiator elements 58a is spaced below an array of antenna radiator elements 58 and disposed such that the exciting signal is transmitted to each of the radiator elements 58 by electromagnetic coupling. As will be seen in FIG. 14, the microstrip feed structure 56 is bonded on the surface of a dielectric substrate 57 and is disposed in substantially parallel relationship to a second cluster array of radiator elements 58 which are bonded to a planar surface of a second dielectric substrate 59. A metallic ground plane 60a is bonded to the opposite surface of the substrate 57. The cluster array of elements 58a and microstrip feed structure 56 are substantially identical to the array 20 and the microstrip feed structure 25 in the antenna 20 shown in FIG. 1.

A particular advantage of the invention 60 is that it reduces undesirable side lobe level increase caused by and spurious radiation from the microstrip feed lines. In addition, while the antenna elements 58 are of square configuration and similar in size and orientation to the array of elements 58a their size can be adjusted so as to fine tune the antenna 60 to operate at a desired center frequency. Another advantage of the antenna 60 is that, for most applications, only the antenna elements 58 are exposed to the outer environment whereas the structure is protected.

A cherished goal in array antenna design is the attainment of high efficiency which in the performance of communications systems manifests itself as higher transmitted signal power and in the received signal as higher signal to noise ratio. The principal cause of reduction in antenna efficiency is conductor loss in the feed line structure. Recent advances in high temperature superconducting (HTSC) technology involving new ceramic materials have made it possible to realize the microstrip array feed line structure in extremely low loss HTSC thin films, such as a thin film of the ceramic material $YBa_2\ Cu_3\ O_{7-x}$ on Lanthanum Alumininate ($LaALO_3$) or sapphire substrates. However, since the radiating elements must interface with the outside world they can not be maintained at the HTSC temperature, which is presently at the same level as liquid nitrogen, and would therefore transfer heat to the feed network if they are in direct contact therewith.

Figure 15:
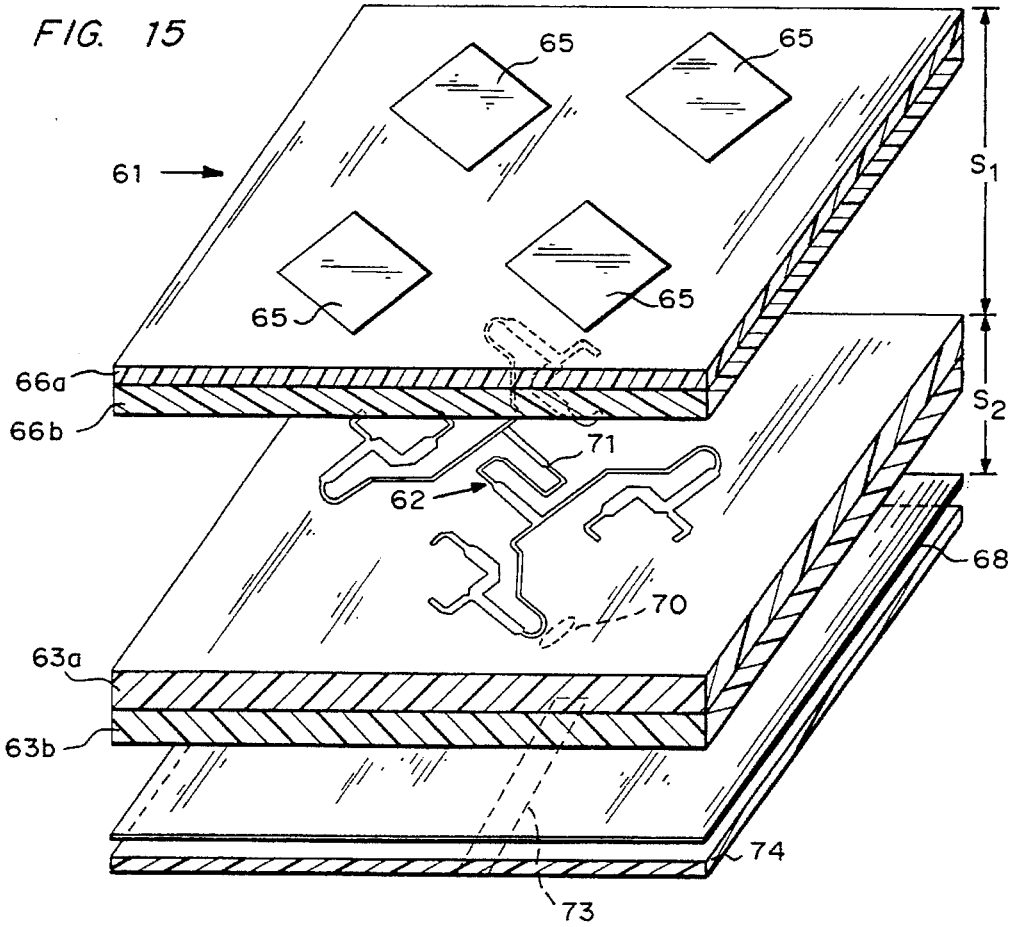
FIG. 15 is a perspective view of a further modification of the invention in which the feed network structure is fabricated from high temperature superconducting thin film and the exciting signal is electromagnetically coupled to the antenna elements.

In a modified form of the invention represented by the antenna 61 shown in FIG. 15, the feed structure is realized in a HTSC thin film 62 superposed on a sheet of dielectric material 63*a*. The sheet 63*a* may in turn be layered atop a second sheet of dielectric material 63*b*.

The feed structure 62 does not directly contact the radiator elements 65 but is electromagnetically coupled thereto when a feed signal is applied. The radiator elements 65, which are of conventional electrical conducting material such as copper are bonded as metal cladding atop a sheet of dielectric material which includes layers 66*a* and 66*b*. The radiator elements 65 are arrayed in the same configuration as the radiator elements in the cluster array 20 of FIG. 1 and reside within a unit cell area similar to the unit cell 29. The elements 65 are also disposed in coplanar relationship to one another and in parallel relation to the plane of the feed structure 62 which is spaced therebelow at a distance $S_1$ which is in the range of 1% to 5% of the operating wavelength of the antenna.

The antenna 61 is also provided with a conducting ground plane 68 formed by a sheet of metal such as copper, which is in parallel relation to the feeder network 62 at a distance $S_2$ therefrom. A wide band oval-shaped aperture 70 is provided in the ground plane 68 at a location which is substantially vertically below the feed point 71 of the thin film feeder network and is adapted to excite the HTSC feed network when it is itself excited by a microstrip feedline 73 bonded to the underside of a sheet of dielectric 74 which is spaced below the plane 68. The microstrip feed line 73 is directly coupled to a signal transmission source (not shown) and is oriented such that the feed line 73, aperture 70 and network feed point 71 are in substantial alignment.

It is to be noted that because of the separation of the feed structure 62 from the radiator elements 65, there is no transfer of heat from the radiator elements to the HTSC material of the feed structure, which is maintained at very low temperature, such as that of liquid nitrogen by an appropriate cryostat (not shown). Such a cryostat would be designed to encompass all sides of the antenna structure except the side thereof which contains the radiator elements 65. Furthermore, there is substantial thermal isolation between the microstrip feed line 73 and the HTSC feed structure 62.

It is to be noted that consistent with the constraints of physical realizations of the radiating antenna structures, the separation distances are so chosen that the antenna at its input is matched at the desired center frequency of operation over the optimum achievable bandwidth.

Figure 16:
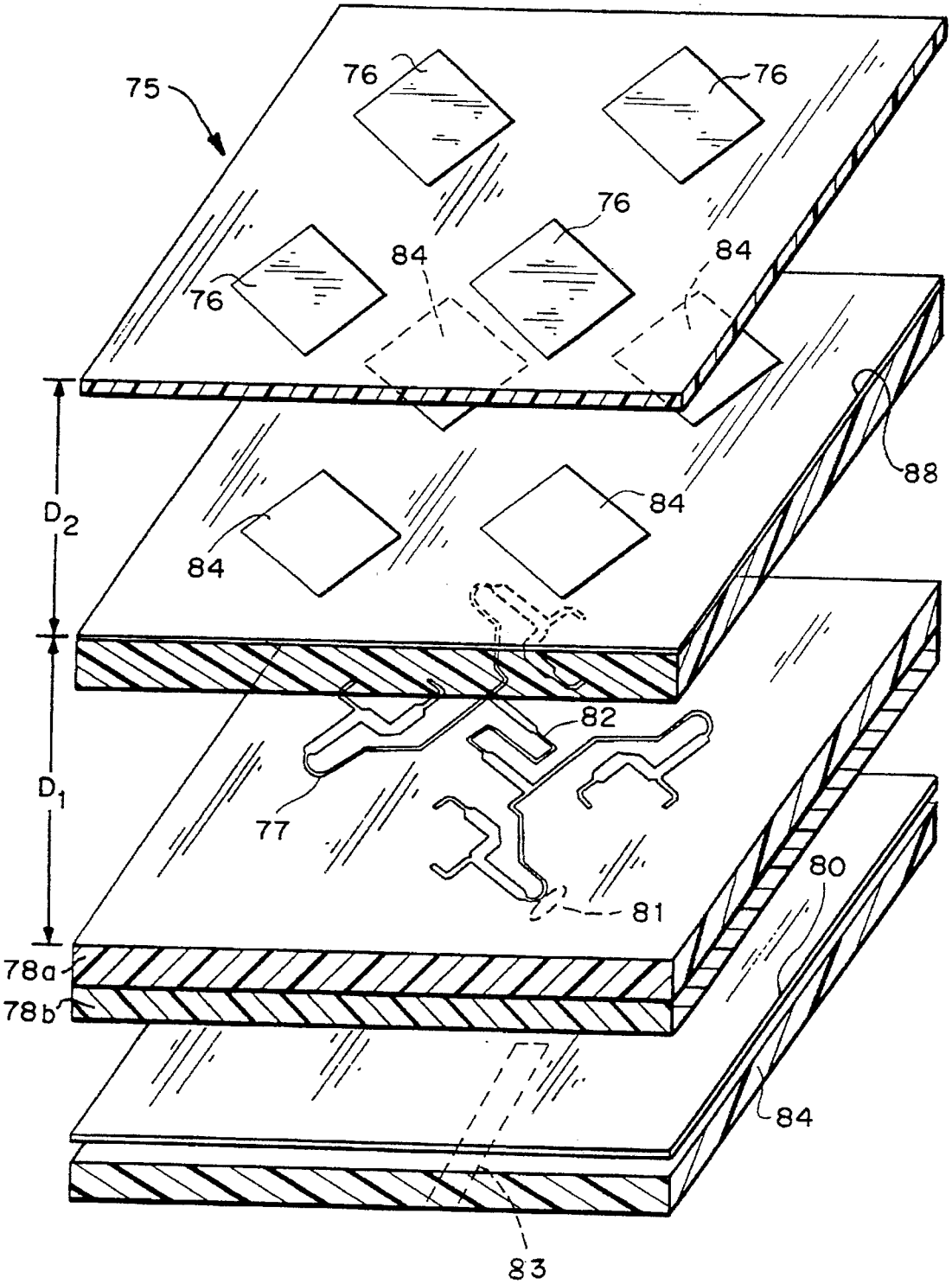
FIG. 16 is a perspective view of a further modification of the invention in which the feed network is of high temperature superconducting thin film and disposed to excite the radiator elements of the antenna through apertures in a conducting plane interposed between the feed network and the radiator elements and the exciting signal is similarly coupled to the feed network.

Another modified form of the invention shown in FIG. 16, comprises a circularly polarized antenna 75 which includes a cluster array of radiator elements 76, corresponding in form and configuration to the radiator elements 65 of the antenna 61 shown in FIG. 15. The feed structure is a feed network 77 of HTSC film, identical in form and configuration to the HTSC feed network 62 of the antenna 61. The feed network 77 is mounted on a sheet of dielectric material comprised of linear sheets 78*a* and 78*b* which is disposed in coplanar relation below the plane of the radiator elements 76 and above a metallic conducting plane 80 spaced in parallel relation therebelow. In like manner to the antenna 61, the feed network 77 is excited by means of a wide band aperture 81 in the conducting plane 80. The aperture 81 is located directly above a microstrip feed line 83 bonded to the underside of a sheet of dielectric 84 spaced from and in parallel relation to the conducting plane 80 such that the center of the aperture is vertically below the feed point 82 of the feed network structure 77.

The antenna 75 differs from the antenna 61 shown in FIG. 15 in that a conducting sheet 88 provided with four apertures 84 is interposed between the radiator elements 76 and the HTSC feed structure 77 at a height $D_1$ above the feed structure and a distance $D_2$ below the array elements 76. The apertures 84, which are of corresponding configuration to the square shape of the radiator elements 76 and similarly oriented, support the same sense of circular polarization as generated by the cluster array 76 when an exciting signal applied to the feed network is electromagnetically coupled to the radiator elements. The vertical separations $D_1$ and $D_2$ may be by one or more layers of dielectric sheets, by air or vacuum or a combination thereof as shown in FIG. 16. These distances $D_1$ and $D_2$ are also chosen such that the antenna at its input is matched at the desired center frequency of operation over the optimum achievable bandwidth. The slot size, the dielectric constants and sheet thicknesses contained in the separation spaces $D_1$ and $D_2$ are parameters that are also selected for optimum matched performance of the antenna structure.

The antenna 75 provides benefits in that the slot excitation of the microstrip radiator patches 76 removes the deleterious effects of coplanar microstrip feed structure on the antenna radiation pattern as are caused by spurious radiation from the feed lines and their bends. It therefore provides a better axial ratio bandwidth which is a particularly desirable feature for many applications.

While the foregoing description of the invention has been presented for purposes of illustration and explanation, it is to be understood that it is not intended to limit the invention to the precise form disclosed. For example, the radiator elements could be in the form of circular discs instead of square patches and a vertical probe feed could be used as an alternative to the coplanar feed. In addition, the planar array of microstrip radiator elements might comprise more than four such elements, as for example, six elements which are oriented at a angle of $$\frac{2\Pi}{N}$$

with respect to one another where N=6 and which are arranged in a hexagon configuration and excited in a phase shift relation corresponding to the orientation angle relationship. It is to be appreciated therefore, that various structural changes may be made by those skilled in the art without departing from the spirit of the invention.

I claim:

1. A microstrip array antenna for radiating circularly polarized electromagnetic waves in the microwave and millimeter wave range, said antenna comprising:

a planar array of microstrip antenna radiator elements formed on one side of a sheet of dielectric material, said array comprising four radiator elements in coplanar relation and arranged with the geometric centers of the radiator elements at the respective corners of a square area having sides with a length dimension d in the range of 0.7 to 0.9 times the wavelength of the operating frequency of the antenna and wherein the four radiator elements reside in a square unit cell area of sides equal to 2d;

an electrically conducting ground plane disposed in parallel spaced relation to said planar array; and means for providing a feed signal in sequential phasing to said planar array of radiator elements for generating circularly polarized radiation, said means comprising a microstrip feeder network coupled to each said radiator element, said feeder network including four T-junction power dividers, each of which is coupled to a different one of the radiator elements to apply inputs of equal magnitude and frequency at two feed points located on mutually orthogonal input axes of the radiator element coupled thereto, each said power divider providing a 90° phase shift to one of its said inputs with respect to the other so as to generate circular polarization radiation of the desired sense, said radiator elements being arranged in a symmetrical orientation wherein the radiator elements and their input axes are relatively rotated in a selected direction of rotation with respect to one another by successive incremental angles of 90° to provide sequential spatial rotation of the feed signal to said radiator elements, said microstrip feeder network further comprising a thin film of high temperature superconducting material disposed in a plane in spaced parallel relation to the plane of said radiator elements and to said electrically conducting ground plane and between said radiator elements and ground plane and positioned relative to said radiator elements such that said radiator elements are electromagnetically coupled to said microstrip feeder network, said antenna further including a microstrip feed line formed on one side of another sheet of dielectric material in a plane in spaced parallel relation to said electrically conducting ground plane and being adapted for electrical connection to a signal transmission source, said electrically conducting ground plane being disposed between said microstrip feeder network and said microstrip feed line and provided with an aperture in alignment with said microstrip feed line and said microstrip feeder network such that a signal supplied to said feed line is electromagnetically coupled through said aperture to the microstrip feeder network for transmission to said radiator elements.

2. A microstrip array antenna for radiating circularly polarized electromagnetic waves in the microwave and millimeter wave range, said antenna comprising:

a cluster array of microstrip antenna radiator elements formed on one side of a sheet of dielectric material, said array comprising four radiator elements in coplanar relation and arranged with the geometric centers of the radiator elements at the respective corners of a square area having sides with a length dimension d in the range of 0.7 to 0.9 times the wavelength of the operating frequency of the antenna and wherein the four radiator elements reside in a square unit cell area of sides equal to 2d;

an electrically conducting ground plane disposed in parallel spaced relation to said planar array;

means for providing a feed signal in sequential phasing to said cluster planar array of radiator elements for generating circularly polarized radiation, said means comprising a microstrip feeder network coupled to each said radiator element, said feeder network including four T-junction power dividers, each of which is coupled to a different one of the radiator elements to apply inputs of equal magnitude and frequency at two feed points located on mutually orthogonal input axes of the radiator element coupled thereto, each said power divider providing a 90° phase shift to one of its said inputs with respect to the other so as to generate circular polarization radiation of the desired sense, said radiator elements being arranged in a symmetrical orientation wherein the radiator elements and their input axes are relatively rotated in a selected direction of rotation with respect to one another by successive angles of 90° to provide sequential spatial rotation of the feed signal to said radiator elements, said feeder network further comprising a thin film of high temperature superconducting material disposed in a plane in spaced parallel relation to the plane of said radiator elements and to said electrically conducting ground plane and between said radiator elements and ground plane and positioned relative to said radiator elements such that said radiator elements are electromagnetically coupled to said microstrip feeder network, a second electrically conducting plane positioned between said array of radiator elements and said high temperature super- conducting feeder network and being provided with four apertures wherein each of said four apertures has a configuration corresponding to the configuration of each of said radiator elements and is positioned in substantial alignment with said high temperature superconducting feeder network and a different one of said radiator elements such that a feed signal applied to said feeder network is coupled from said feeder network through each of said apertures to different ones of said radiator elements; and a microstrip feed line formed on one side of another sheet of dielectric material in a plane in spaced parallel relation to said electrically conducting ground plane and being adapted for electrical connection to a signal transmission source, said electrically conducting ground plane being disposed between said microstrip feeder network and said microstrip feed line and provided with an aperture in alignment with said microstrip feed line and said microstrip feeder network such that a signal supplied to said feed line is electromagnetically coupled through said aperture to the microstrip feeder network for coupling to said radiator elements.

3. A microstrip array antenna as set forth in claim 2 wherein each said microstrip radiator element is of square shape.

* * * * *